United States Patent [19]

Franke

[11] 4,446,468

[45] May 1, 1984

[54] SINGLE PIECE TRIGGER AND KNOCK OFF MECHANISM

[75] Inventor: George Franke, Amherst, N.H.

[73] Assignee: Simplex Time Recorder Co., Gardner, Mass.

[21] Appl. No.: 410,164

[22] Filed: Aug. 20, 1982

[51] Int. Cl.[3] ..... G07C 1/06

[52] U.S. Cl. ..... 346/82; 346/104; 200/61.59

[58] Field of Search ..... 346/82, 83, 84, 85, 346/86, 95, 96, 104, 134; 400/521; 200/61.59

[56] References Cited

U.S. PATENT DOCUMENTS

| | | | |
|---|---|---|---|
| 1,799,752 | 4/1931 | Larrabee | 346/86 |
| 1,979,208 | 10/1934 | Friden | 346/82 X |
| 2,389,345 | 11/1945 | Dell et al. | 346/86 |
| 2,393,761 | 1/1946 | Eidmann et al. | 346/95 |
| 2,454,025 | 11/1948 | Amend, Jr. et al. | 346/95 |
| 2,479,768 | 8/1949 | Myer | 346/95 |
| 2,649,352 | 8/1953 | Frick | 346/95 |
| 2,736,023 | 2/1956 | Williams | 346/88 |
| 2,784,051 | 3/1957 | Pagnard | 346/81 |
| 2,824,777 | 2/1958 | Gieringer | 346/83 |
| 2,906,505 | 9/1959 | Orr et al. | 346/82 |
| 2,968,521 | 1/1961 | Gross | 346/85 |
| 2,981,586 | 4/1961 | Kawachi | 346/82 |
| 3,030,013 | 4/1962 | Moodie, Sr. et al. | 346/66 |
| 3,241,151 | 3/1966 | Logie et al. | 346/60 |
| 3,324,477 | 6/1967 | Hooper | 346/82 |
| 3,405,867 | 10/1968 | Stewart | 346/86 |
| 3,512,175 | 5/1970 | Williams | 346/82 |
| 3,541,574 | 11/1970 | Weiss | 346/82 |
| 3,638,233 | 1/1972 | Futter | 346/82 |
| 3,638,234 | 1/1972 | Fiannaca | 346/95 |
| 3,789,424 | 1/1974 | Majorino | 346/95 |
| 3,849,783 | 11/1974 | Tringali et al. | 346/134 |
| 4,128,237 | 12/1978 | Bechtiger | 346/95 |

FOREIGN PATENT DOCUMENTS

| | | | |
|---|---|---|---|
| 392148 | 5/1933 | United Kingdom | 346/82 |

*Primary Examiner*—Joseph W. Hartary
*Attorney, Agent, or Firm*—Seidel, Gonda & Goldhammer

[57] ABSTRACT

A single piece trigger and knock off mechanism for a switch operated card printer includes a lever integrally connected to a resilient mounting bracket which provides a first flexural pivot. The lever comprises a pair of integrally connected arms, each provided with an ear. A moving card contacts the ear on one arm, causing the lever to swing about the first flexural pivot. As the lever swings, the ear on the other arm contacts a switch which triggers a card printer solenoid. The solenoid operates a card printer hammer. The card printer hammer is driven towards the card when the solenoid is triggered. As the hammer is driven towards the card, a moveable element associated with the card printer strikes the arm whose ear is in contact with the switch, causing the arm to swing about a second flexural pivot formed by a bend in the arm. As the arm swings, the ear releases the switch. This knocks off the solenoid just before the hammer contacts the card.

11 Claims, 14 Drawing Figures

FIG. 8A
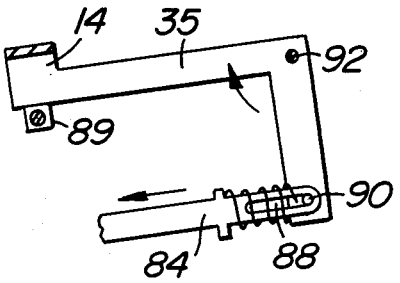
FIG. 8B
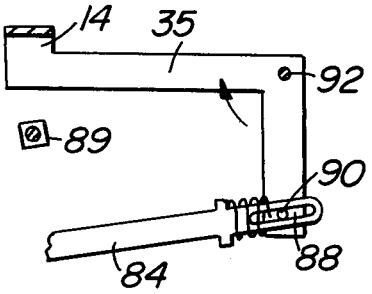
FIG. 8D
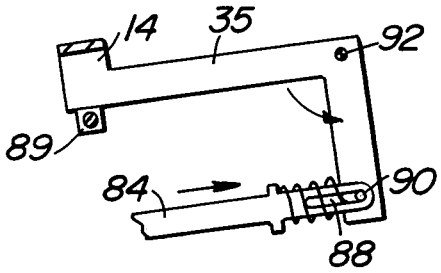
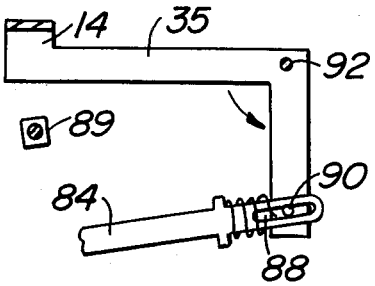
FIG. 8C
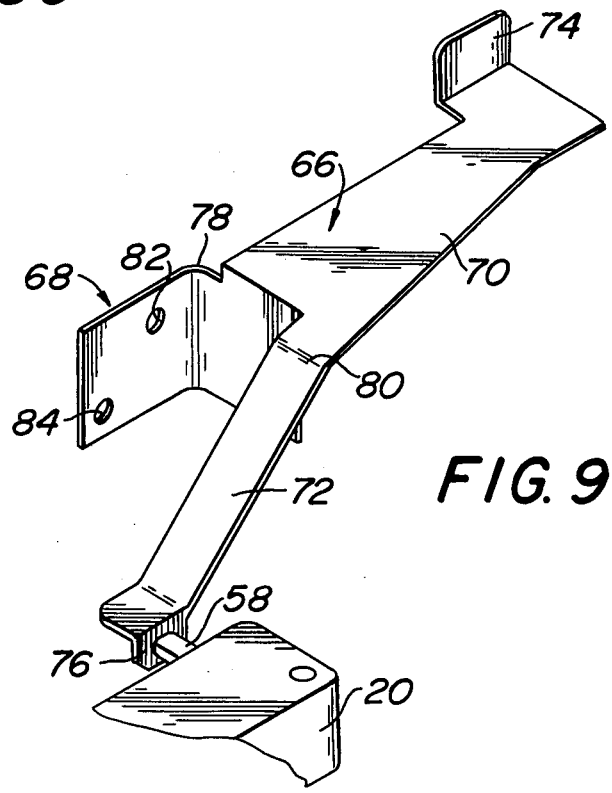
FIG. 9

SINGLE PIECE TRIGGER AND KNOCK OFF MECHANISM

BACKGROUND OF THE INVENTION

The present invention is directed to a single piece trigger and knock off mechanism. Trigger and knock off mechanisms are well-known in the time recorder field wherein a card or other document is to be imprinted with data such as attendance times and the like. The trigger and knock off mechanism controls a switch operable card printer which includes a print hammer for printing the data on the card. During a print operation, the print hammer strikes the card, pressing the card against an inked ribbon and the characters or numerals on one or more typewheels, and then rebounds from the card.

The card printer includes a switch operated solenoid which drives the print hammer. The trigger and knock off mechanism must close the switch to fire or trigger the solenoid when a card is inserted in the time recorder. The mechanism must also open the switch to de-energize or knock off the solenoid just before the print hammer strikes the card. By "knocking off" the solenoid is meant deenergizing the solenoid so that the print hammer is driven by the solenoid only during part of its flight. Just before and after striking the card, the print hammer must move freely under its own inertia so that the hammer can strike the card in free flight and then rebound in free flight without striking the card a second time.

Conventionally, trigger and knock off mechanisms comprise multiple interrelated parts which enhance manufacturing costs, cost of assembly and susceptability to wear.

An object of the present invention is to provide a trigger and knock off mechanism which is a single integral unit, simplifying manufacture, installation and repair or replacement.

Another object of the invention is to provide a trigger and knock off mechanism which operates reliably while experiencing relatively little wear.

Other objects and advantages of the invention appear hereinafter.

BRIEF SUMMARY OF THE INVENTION

Single piece trigger and knock off mechanism comprising a lever integrally connected to a resilient mounting bracket. The lever is swingable about a first flexural pivot provided by the resilient mounting bracket. The lever comprises a pair of arms. Each arm is provided with an ear. The ear of the first arm lies in the path of a card or other document which is to be printed by means of a card printer hammer. The ear of the second arm contacts a switch which triggers a card printer solenoid as the lever swings about the first flexural pivot. The second arm is adapted to swing or flex about a second flexural pivot located along the arm. A crank associated with the card printer strikes the second arm, causing the arm to flex about the second flexural pivot whereby the ear of the arm releases the switch to knock off the solenoid just before the hammer strikes the card.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIGS. 8A–8D are diagramatic representations of the relative positions of the print hammer and connecting rod of the card printer shown in FIG. 5.

FIG. 9 is a perspective of an alternative embodiment of the trigger and knock off mechanism of the present invention.

DETAILED DESCRIPTION OF THE INVENTION

Figure 1:
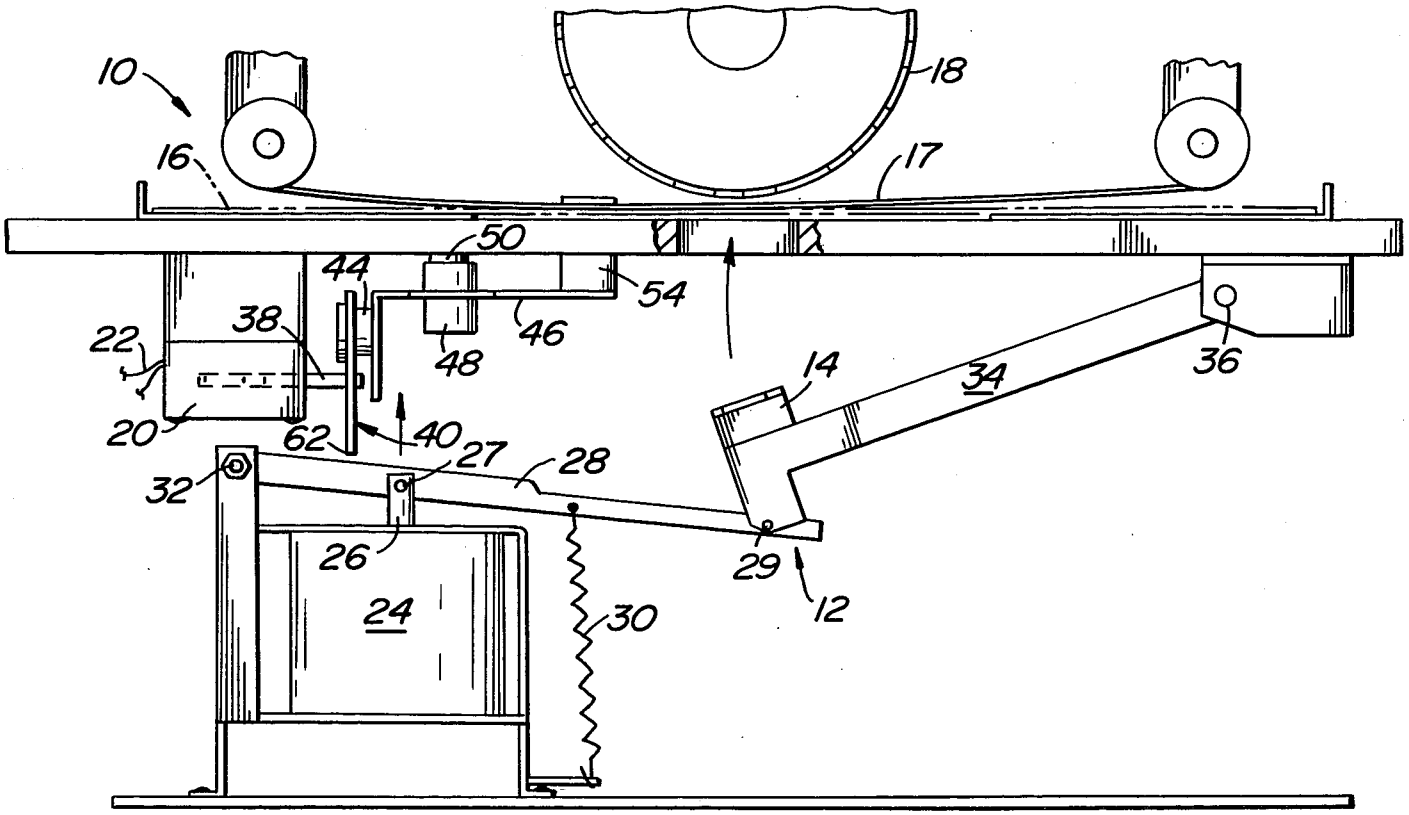
FIG. 1 is a front elevation of the internal components of a time recorder showing the card printer and trigger and knock off mechanism of the prior art.

Referring to the drawings wherein like numerals indicate like elements, there is shown in FIG. 1 a front elevation of the trigger and knock off mechanism and card printer of the prior art time recorder designated generally as 10. The time recorder 10 includes a switch operated card printer 12 comprising a print hammer 14 for imprinting data on a time card 16 by striking the card against an inked ribbon 17 and one or more typewheels 18. The typewheels carry indicia such as characters or numerals indicative of time data and the like.

A switch 20 is connected by wires 22 to a card printer solenoid 24 provided with a movable plunger 26. Plunger 26 is pivotably coupled to a stud 27 on a lever 28. Lever 28 is pivotably coupled at one end to a pin 32 mounted on supporting structure (not shown). When the solenoid is fired or actuated by the switch, the plunger 26 displaces lever 28 upwardly. The lever is biased in the rest position by a spring 30. A second lever 34, which carries the print hammer 14, is pivotably coupled to a stud 29 at the other end of lever 28. When lever 28 swings upwardly about pin 32, it causes lever 34 to swing upwardly about a pin 36 mounted on supporting structure (not shown).

Figure 2:
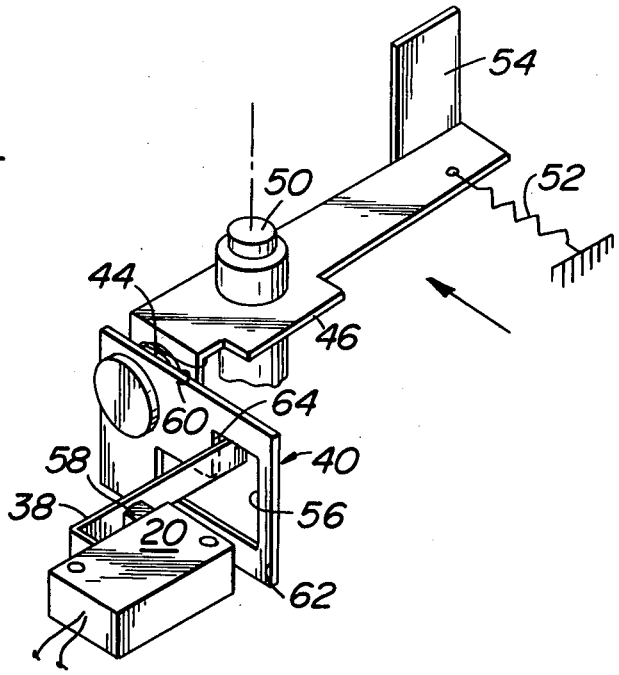
FIG. 2 PRIOR ART
FIG. 2 is a diagrammatic representation showing the multiple interrelated parts of the prior art trigger and knock off mechanism.

The switch 20 includes a resilient switch blade 38 which is operated by a switch control plate 40 rotatably mounted on a shaft 44 secured to a lever 46. See FIG. 2. The lever 46 is rotatably mounted on a shaft 50 secured to supporting structure (not shown). The lever 46 is biased in the rest position by a spring 52 coupled to supporting structure. An ear 54 is provided at the extremity of the lever 46.

A card inserted in the time recorder in the direction indicated by the arrow (FIG. 2) contacts ear 54, swinging the lever 46 in the counter clockwise direction about shaft 50, against the return force of spring 52. The switch control plate 40 is provided with a profile or cut out 56 having an edge 64 which contacts the switch blade 38 and presses the blade against a switch button 58 to close the switch and fire the solenoid 24. When the solenoid is fired, the plunger 26 swings lever 28 upwardly about pin 32 against the return force of spring 30. The lever 34 therefore swings upwardly about pin 36, and the print hammer 14 approaches the card.

The switch control plate 40 is coupled by a torsional spring 60, wound about shaft 44, to the lever 46. See FIG. 2. As the lever 28 swings upwardly, it contacts the corner portion 62 of the switch control plate, see FIG. 1, causing the plate to rotate counter-clockwise about shaft 44 against the return force of spring 60. As a result, the cut out 56 is tilted so that edge 64 moves past switch blade 38, freeing the blade The blade then springs back to its rest position, releasing the button 58 and opening the switch to knock off the solenoid.

Although the solenoid is knocked off, the lever 34 and print hammer 14 continues in free flight towards the time card, and the print hammer strikes the card in free flight to imprint the desired data on the card. The print hammer rebounds a short distance in free flight from the card, and spring 30 then returns levers 28 and 34 to their rest positions. As lever 28 returns to its rest position, it releases the switch control plate 40, and the switch control plate rotates clockwise about shaft 44 under the return force of torsional spring 60 to return to its rest position.

The foregoing operations occur almost instantaneously upon insertion of the card into the time recorder. When the card is withdrawn from the time recorder the spring 52 swings the lever 46 about shaft 50 back to its rest position. The switch control plate returns to its rest position with edge 64 cleared of switch blade 38. The switch blade 38 remains at rest free of switch button 58.

Figure 3A:
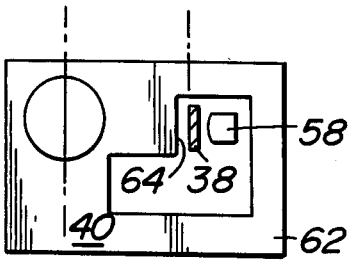
FIGS. 3A–3C are diagrammatic representations of the relative positions of the switch blade and switch control plate of the prior art trigger and knock off mechanism shown in FIG. 2.
Figure 3B:
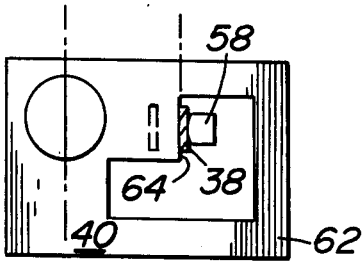
Figure 3C:
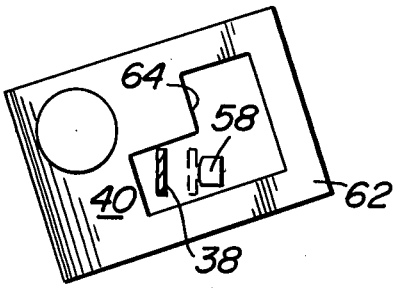

The movement of the switch control plate 40 is shown diagrammatically in FIGS. 3A–3C. As shown in FIG. 3A, blade 38 is initially spaced from edge 64 and switch button 58 and the switch 20 is open. As shown in FIG. 3B, when the time card is inserted in the recorder, edge 64 presses switch blade 38 against button 58 to close switch 20 and fire solenoid 24. As shown in FIG. 3C, as the print hammer flies towards the card, edge 64 swings past the switch blade, and the blade returns to its rest position spaced from switch button 58 thereby opening the switch and knocking off solenoid 24.

Although operation of the prior art trigger and knock off mechanism is acceptable, the mechanism comprises a dozen or more interrelated parts such as shaft 50, spring 52, shaft 44, torsional spring 60, and switch control plate 40. This complicates manufacture, assembly, and repair or replacement of the trigger and knock off mechanism. The single piece trigger and knock off mechanism of the present invention eliminates these parts. The single piece trigger and knock off mechanism is shown in FIGS. 4–7.

Figure 4:
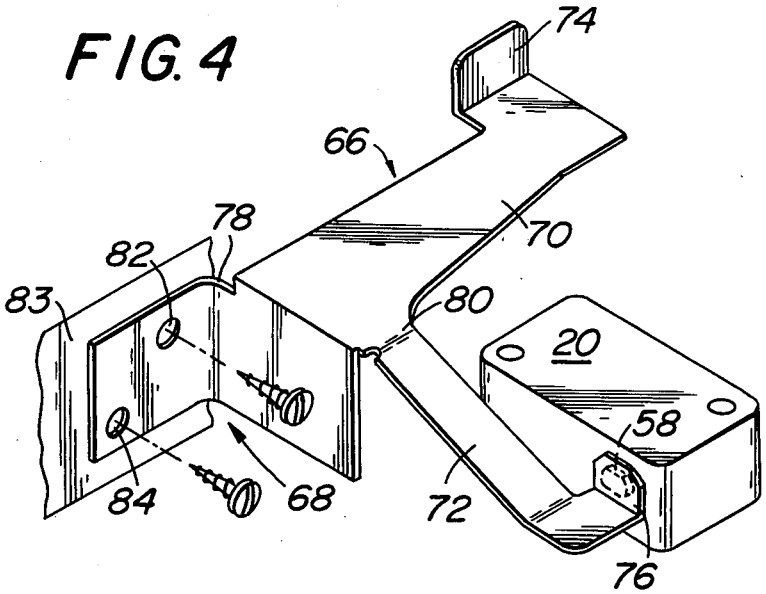
FIG. 4 is a perspective of the trigger and knock off mechanism of the present invention.

Referring to FIG. 4, the single piece trigger and knock off mechanism comprises a lever 66 integrally connected to a resilient mounting bracket 68. The entire mechanism, including the lever 66 and mounting bracket 68 is preferably made of resilient metallic material although other materials having like resiliency may also be suitable. The lever 66 comprises a pair of arms 70, 72. Arms 70, 72 are respectively provided with ears 74, 76. A bend 78 is formed in the mounting bracket 68 to form a first substantially vertical flexural pivot for both lever arms. A second bend 80 is formed along arm 72 to define a second substantially horizontal flexural pivot for the arm.

The mounting bracket 68 is mounted by screws or the like on supporting structure 83 inside the time recorder, at mounting holes 82, 84. As shown in FIG. 4, the switch 20 may be modified by omitting the switch blade 38 when the single piece trigger and knock off mechanism is used.

Figure 7:
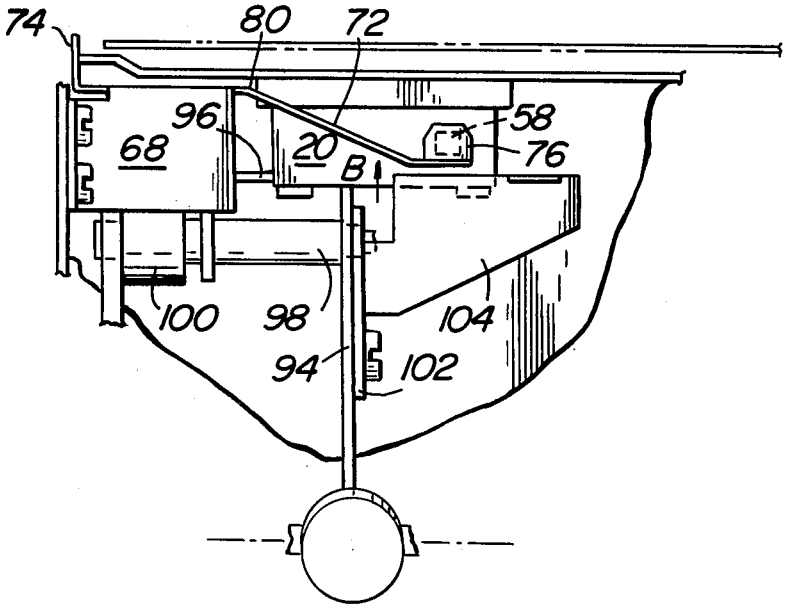
FIG. 7 is a side elevation of the trigger and knock off mechanism shown in FIG. 5.
Figure 5:
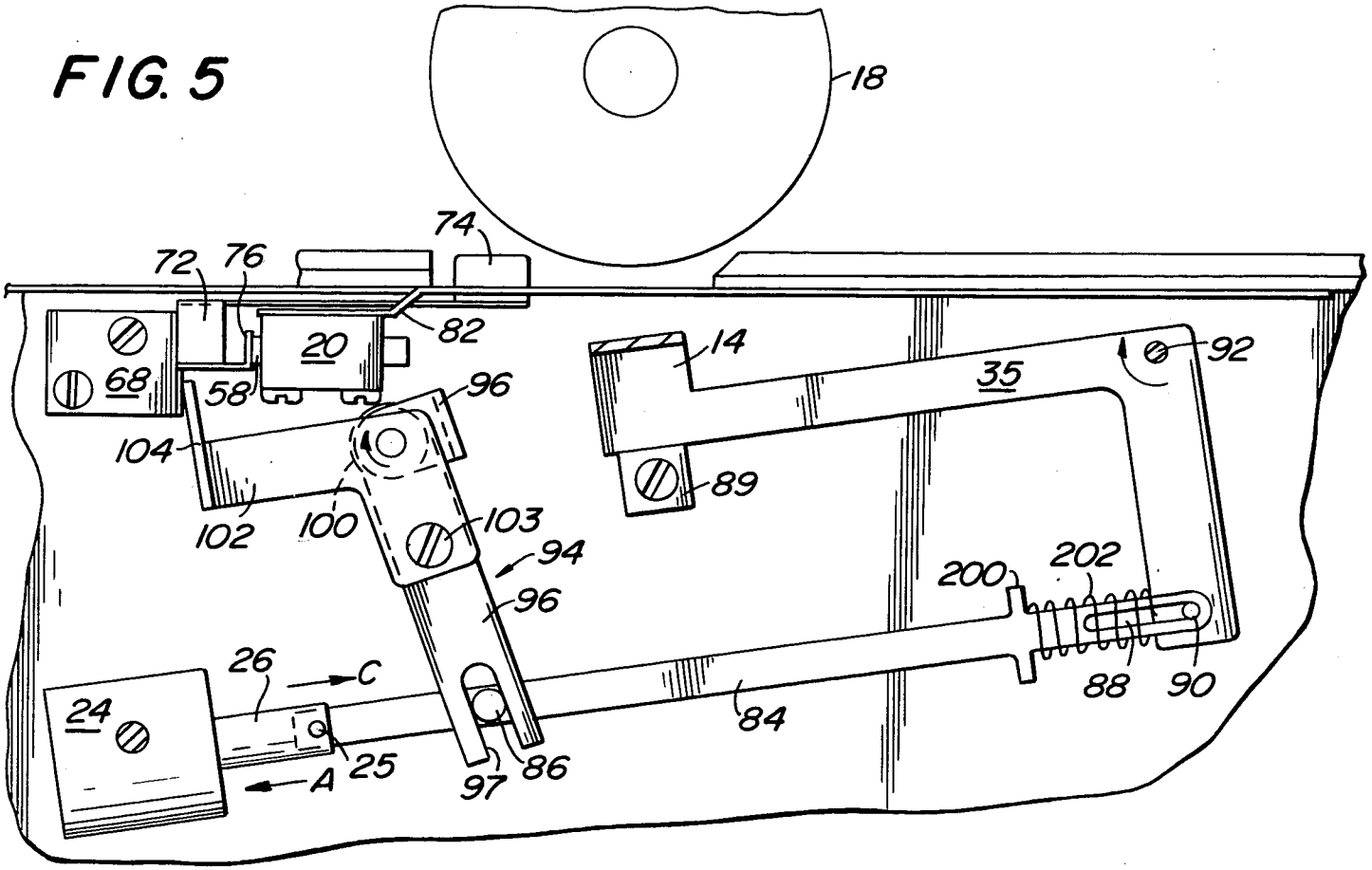
FIG. 5 is a front elevation of the trigger and knock off mechanism of the present invention in operative relation with the card printer within a time recorder.
Figure 6:
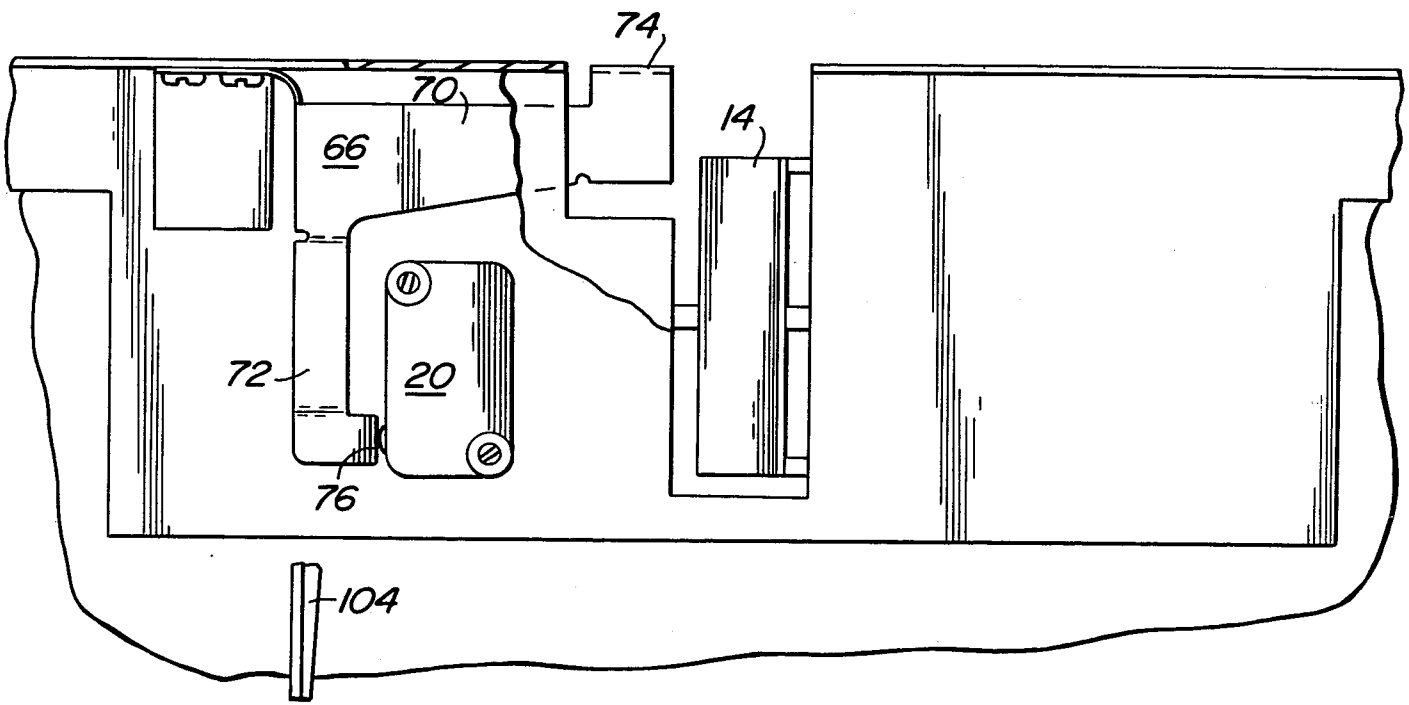
FIG. 6 is a plan view of the trigger and knock off mechanism shown in FIG. 5.

Referring to FIGS. 5–7, the switch 20 is fastened to the underside of the time recorder top wall 82. In FIGS. 5–7, it is presumed that a time card (not shown) has been inserted in the time recorder (into the plane of FIG. 5) so as to contact ear 74 and swing lever 66 in the counter-clockwise direction about the first flexural pivot defined by bend 78 in resilient mounting bracket 68. Accordingly, the ear 76 is shown in contact with switch button 58. Switch 20 is therefore closed, firing the solenoid 24.

The plunger 26 is pivotably coupled to a stud 25 on a connecting rod 84. The rod 84 is provided with a stud 86 at a medial location, and with a lost motion slot 88 at the distal end. A crank 35 is coupled to rod 84 by means of stud 90 seated in slot 88. The crank 35 carries the print hammer 14. The crank is pivotably mounted on a pin 92 coupled to supporting structure (not shown) within the time recorder.

A crank 94 comprising a single piece link and clevis 96 is rotatably mounted on a shaft 98 journaled in a bearing 100 secured to the time recorder supporting structure. The link and clevis 96 is coupled to rod 84 by means of an open ended slot 97 in which stud 86 is seated. Crank 94 also includes a crank arm 102 secured to link and clevis 96 by means of a screw 103. The crank arm 102 is a single piece unit including a right angle finger 104.

The rod 84 is provided with an annular rib 200 at its distal end. See FIG. 5. A compression spring 202 is seated on the rod, between rib 200 and the crank 35. A stop 89 is screw fastened to supporting structure within the time recorder. The crank 35 rests atop stop 89 when the crank is in its initial or rest position as shown in FIG. 5, and spring 202 presses against the crank 35 to ensure that pin 90 contacts the extremity of slot 88.

When the solenoid 24 is fired, the plunger 26 retracts in the direction indicated by the arrow A in FIG. 5, pulling rod 84 to the left so as to pivot crank 94 in the clockwise direction around shaft 98 while pivoting crank 35 in the clockwise direction around pin 92. The print hammer 14 swings upwardly towards the time card. The crank arm 102 also swings upwardly, and the finger 104 moves (as indicated by arrow B in FIG. 7) into contact with the underside of lever 72, flexing lever 72 upwardly about the second flexural pivot defined by bend 80. The ear 76 therefore moves out of contact with switch button 58, opening switch 20 and knocking off solenoid 24. Shortly thereafter the plunger 26 bottoms out, and rod 84 is no longer pulled to the left by the plunger.

Although the solenoid has been knocked off, the crank 35 continues to swing upwardly in free flight so that print hammer 14 strikes the time card. The print hammer then rebounds from the card in free flight under gravity. During rebound, crank 35 pulls rod 84 to the right as indicated by arrow C in FIG. 5. As the rod 84 is pulled to the right, it swings crank 94 in the counterclockwise direction (downwardly). When crank 35 contacts stop 89, the crank, rod 84 and crank 94 are in their initial or rest positions.

The foregoing operations occur almost instantaneously upon insertion of the card in the time recorder.

When the time card is withdrawn, lever 66 swings back to its rest position. In particular, arm 70 swings forward, that is, in the clockwise direction about the first flexural pivot provided by bend 78; and arm 72 swings downwardly about the second flexural pivot provided by bend 80. In the rest position of lever 66, ear 76 is spaced from switch button 58 so that the switch remains open and solenoid 24 remains de-energized. Accordingly, the mechanism is reset.

The length of slot 88 is chosen so that pin 90 rides through the slot while the print hammer 14 is in free flight. Thus, slot 88 serves as a lost motion slot, which determines the extent of travel of the print hammer in free flight towards and away from the time card. The relative positions of the connecting rod 84, lost motion slot 88 and pin 90 during firing and knock off are shown in FIGS. 8A–8D.

Referring to FIG. 8A, the extremity of slot 88 contacts pin 90 when rod 84 and crank 35 are in their initial positions. Accordingly, crank 35 swings upwardly due to retraction of plunger 26 as the solenoid fires. FIG. 8B shows the continued upward swing of the print hammer 14 in free flight after the solenoid 24 is knocked off. The solenoid plunger has bottomed out, i.e., has stopped moving to the left, so that rod 84 is no longer being pulled to the left. Crank 35 continues to swing upwardly, however so that stud 90 rides to the left within slot 88. FIG. 8C shows the beginning of the downward swing of crank 35 in free flight during rebound after the solenoid has been knocked off. The stud 90 now starts to ride to the right within slot 88 as the crank 35 falls downwardly in free flight under gravity. FIG. 8D shows the return of crank 35 to its initial position against stop 89. As the crank returns to its initial position, pin 90 contacts the extremity of slot 88 and pulls rod 84 to the right so as to return the rod to its initial position.

Although the invention has been described in terms of a lever 66 having arms 70 and 72 at approximate right angles, other arrangements of the lever arms are also possible without exceeding the scope of invention. For example, the arms 70 and 72 may be disposed at approximate 180° positions while operating in the manner already described, as represented by the embodiment shown in FIG. 9.

The present invention may be embodied in other specific forms without departing from the spirit or essential attributes thereof and, accordingly, reference should be made to the appended claims, rather than to the foregoing specification, as indicating the scope of the invention.

I claim:

1. Single piece trigger and knock off mechanism for a switch operable card printer and a moveable element operatively associated therewith comprising:

a first arm disposed to be contacted by a moving card, a second arm disposed to be contacted by a moveable element operatively associated with a switch operable card printer, a pivot member, said first and second arms being integrally connected to each other and to said pivot member so that the arms are pivotably displaceable together in a first direction about a first pivot axis upon contact between the first arm and the moving card, said second arm being constructed and arranged so that it is pivotably displaceable in a second direction about a second pivot axis upon contact with the moveable element of the card printer, said second arm being disposed to contact a switch which operates the card printer upon displacement in said first direction and to release the switch upon displacement in the second direction.

2. Single piece trigger and knock off mechanism according to claim 1 wherein said pivot member is a flexural pivot member.

3. Single piece trigger and knock off mechanism according to claim 1 wherein said second arm is made of resilient material and is constructed and arranged so that the arm is flexurally displaceable with respect to said second pivot axis.

4. Single piece trigger and knock off mechanism for a switch operable card printer and a moveable element operatively associated therewith comprising:

a lever constructed and arranged for flexural displacement in a first direction about a first axis and in a second direction about a second axis, said lever being disposed to be contacted by a moving card whereby the lever is displaced in said first direction about said first axis and to be contacted by a moveable element operatively associated with a switch operable card printer whereby the lever is displaced in said second direction about said second axis, said lever being disposed so as to contact a switch which operates the card printer upon displacement in said first direction and to release the switch upon displacement in said second direction.

5. Single piece trigger and knock off mechanism according to claim 4 wherein said lever is a single-piece unit constructed of a resilient material.

6. Single piece trigger and knock off mechanism according to claim 5 wherein said lever comprises first and second integrally connected arms flexurally displaceable together in said first direction about said first axis, said second arm being constructed and arranged for flexural displacement in said second direction about said second axis, said first arm being disposed to be contacted by the moving card and said second arm being disposed to contact the switch upon displacement in the first direction and to be contacted and displaced in said second direction by the moveable element associated with the card printer whereby the second arm is flexurally displaced in the first direction to contact the switch and is flexurally displaced in the second direction to release the switch.

7. Single piece trigger and knock off mechanism for a switch operable card printer and a moveable element operatively associated therewith comprising:

first and second integrally connected arms, a resilient mounting member integrally connected to said first and second arms, said first and second arms being constructed and arranged so as to be flexurally displacable together in a first direction, said second arm being constructed and arranged so as to be flexurally displacable in a second direction, said first arm being disposed to be contacted by a moving card whereby the first and second arms are flexurally displaceable together in the first direction, said second arm being disposed so as to be contacted by the moveable element associated with the card printer whereby the second arm is flexurally displaceable in the second direction, said second arm being disposed so as to contact a switch which operates the card printer upon displacement in the first direction and so as to release the switch upon displacement in the second direction.

8. Single piece trigger and knock off mechanism according to claim 7 wherein said second arm is constructed of a resilient material and is provided with a bend so as to be flexurally dispaceable about the bend in said second direction.

9. Single piece trigger and knock off mechanism according to claim 7 wherein said resilient mounting member is provided with a bend and is connected to said first and second arms such that said first and second arms are flexurally displacable about the bend in said second direction.

10. Single piece trigger and knock off mechanism for a switch operable card printer and a moveable element operatively associated therewith comprising:

first and second integrally connected arms, a flexural pivot member, said first and second arms being integrally connected to said flexural pivot member so as to be flexurally displaceable together in a first direction, said second arm being constructed and arranged so as to be flexurally displaceable in a second direction transverse to said first direction, said first arm being disposed to be contacted by a moving card whereby the first and second arms are flexurally displaceable together in said first direction, said second arm being disposed to contact a switch which operates the card printer upon displacement in the first direction, said second arm being disposed so as to be contacted and flexurally displaced in the second direction by the moveable element associated with the card printer so as to release the switch.

11. Single piece trigger and knock off mechanism according to claim 10 wherein said flexural pivot member is adapted to be mounted on a supporting structure.

* * * * *